US007937915B2

(12) United States Patent
Kohn et al.

(10) Patent No.: US 7,937,915 B2
(45) Date of Patent: May 10, 2011

(54) HAND DISPENSER FOR STRETCH WRAP

(75) Inventors: Albert Kohn, Woodmere, NY (US); Johan Blok, Perth Amboy, NJ (US); Al Saraisky, Butler, NJ (US)

(73) Assignees: Broadway Kleer-Guard Corp., Edison, NJ (US); M.S. Plastics, Butler, NJ (US)

( * ) Notice: Subject to any disclaimer, the term of this patent is extended or adjusted under 35 U.S.C. 154(b) by 194 days.

(21) Appl. No.: 11/506,040

(22) Filed: Aug. 17, 2006

(65) Prior Publication Data

US 2008/0072538 A1 Mar. 27, 2008

(51) Int. Cl.
*B65B 67/08* (2006.01)
*B65B 53/00* (2006.01)
*B65H 16/04* (2006.01)

(52) U.S. Cl. ..... 53/556; 53/592; 53/390; 242/422.4; 242/588.2; 242/597.3; 242/597.4

(58) Field of Classification Search ..... 53/358, 53/581, 592, 390, 393, 556, 582, 588; 83/649; 242/422.4, 423.1, 588.2, 597, 597.3, 597.4; *B65B 67/08; B65H 16/02, 16/04*
See application file for complete search history.

(56) References Cited

U.S. PATENT DOCUMENTS

| | | | | | |
|---|---|---|---|---|---|
| 4,477,037 | A * | 10/1984 | Goldstein | 242/423.2 |
| 4,484,717 | A * | 11/1984 | Goldstein | 242/422.1 |
| 4,535,951 | A * | 8/1985 | Riemenschneider, III | 242/423.2 |
| 4,575,020 | A * | 3/1986 | Strout et al. | 242/422.1 |
| 4,722,493 | A * | 2/1988 | Parry et al. | 53/390 |
| 4,752,045 | A * | 6/1988 | Goldstein | 242/588.2 |
| 4,817,762 | A * | 4/1989 | Powell | 242/422.4 |
| 4,872,623 | A * | 10/1989 | Parry et al. | 242/422.4 |
| 4,989,803 | A * | 2/1991 | Lambert et al. | 242/422.4 |
| 5,203,517 | A * | 4/1993 | Parry et al. | 242/422.4 |
| 6,102,323 | A * | 8/2000 | Riemenschneider | 242/422.4 |
| 6,508,430 | B1 * | 1/2003 | Rodriguez | 242/588.2 |
| 6,517,023 | B2 * | 2/2003 | Rodriguez | 242/422.4 |
| 7,040,370 | B2 * | 5/2006 | Miller | 242/588.2 |
| 2006/0032965 | A1 * | 2/2006 | Yu Chen | 242/422.4 |
| 2006/0278751 | A1 * | 12/2006 | Chen | 242/588.2 |
| 2007/0151208 | A1 * | 7/2007 | Huang | 53/390 |

FOREIGN PATENT DOCUMENTS

| | | | |
|---|---|---|---|
| EP | 310291 | A1 * | 4/1989 |
| GB | 2203726 | A * | 10/1988 |
| GB | 2299321 | A * | 10/1996 |

* cited by examiner

*Primary Examiner* — Stephen F Gerrity

(74) *Attorney, Agent, or Firm* — Philip M. Weiss; Weiss & Weiss

(57) ABSTRACT

A hand dispenser for stretch film. The stretch film from the hand dispenser is dispensed by using one hand from a person. The hand dispenser comprises a handle with prongs, a collar with a flange and a notched cylinder with flexible sections, and a foam sleeve for a cushion grip. The handle prongs are inserted into the extended core of the roll. The film is wound around one end of the extended core.

20 Claims, 2 Drawing Sheets

HAND DISPENSER FOR STRETCH WRAP

FIELD OF THE INVENTION

The present invention relates to a hand dispenser for stretch wrap.

BACKGROUND OF THE INVENTION

U.S. Pat. No. 4,722,493 relates to a holder for dispensing stretch film from a roll comprising a cylindrical body and an arbor rotatably supported on the body. A flexible grip having internal ribs covers the body and the arbor, so that one can by applying finger pressure to the grip brake rotation of the arbor and thus control film tension. The patent teaches that the holder comprises a handle which includes a substantially cylindrical body and a shaft extending from one end of the body. An arbor is journaled on the shaft. Means on the arbor engage the film roll, thereby constraining the roll and the arbor to rotate together on the shaft. A collar is on the arbor adjacent the handle body. One holding the handle body may create a braking torque on the roll by applying radial pressure to the collar.

U.S. Pat. No. 5,203,517 relates to a dispenser for a stretch wrap film with cylindrical bearings. The dispenser has a spindle at the end which forms a hub which attaches to the core of the film roll and rotates with the roll as the film is unwound. The spindle extends coaxially from the core of the film roll and is partially surrounded by a flexible hand grip. Bearings are coaxially mounted on the spindle and interposed beneath part of the hand grip so that the spindle may rotate freely with respect to the hand grip. Part of the hand grip engages the spindle without interposition of bearings. The dispenser requires a first sleeve bearing mounted coaxially on the shaft adjacent the hub, a break drum mounted coaxially on the shaft adjacent the first sleeve bearing, a second sleeve bearing mounted on the shaft adjacent the other end of the brake drum and a single flexible hand grip.

U.S. Pat. No. 4,575,020 relates to a portable chuck for dispensing under tension roll of wrapping material. The portable chuck includes an expandable spindle insertable within one end of the tubular core, and a handle for selectively expanding the spindle to create a braking force. The chuck is formed from first and second chuck pieces, each of which includes a spindle portion, collar and handle portion. A fulcrum means is disposed between the first and second chuck pieces above the collar.

U.S. Pat. No. 4,522,348 relates to a dispenser for stretch film having a manual braking mechanism. First and second side members are adjacent to each side of a roll wrapping material. Each of these side members has a bearing member disposed thereon for supporting the core. At least one of the bearing members is insertable into the core and has an expandable bearing surface.

U.S. Pat. No. 5,094,395 relates to an apparatus and method for dispensing plastic stretch film wherein a hollow core supply roll of stretch film is dispensed in a controlled manner utilizing a brake means mounted within the core. This urges by its own resiliency against the inside surface of the core while permitting frictionally retarded axially rotation of the core about the brake and having handles connected to the brake means.

U.S. Pat. No. 4,714,211 relates to a dispenser for applying plastic packaging film under tension about an object of large volume. The dispenser comprises a base with a handle and a roll support structure at opposite ends. The roll support structure comprises a tube that is adjustable relative to the base.

There is provided a means to secure the tube in a selected position, together with a tension applying means in connection with a hand grip attached to the upper end of the roll support structure.

U.S. Pat. No. 5,311,725 relates to a stretch wrap packaging machine which has a support frame and a rotatable frame rotatably mounted on the support frame. A dispenser is mounted on the rotatable frame to follow an orbital path. The dispenser has a web tensioning system. At least one actuation ring is mounted on the support frame. An activator moves the actuation ring to cooperate with the tensioning system.

U.S. Pat. No. 5,941,049 relates to a method and apparatus for stretch wrapping a load. A leading end of packaging materials is placed in a retainer to hold the leading end of the packaging material. Packaging material is dispensed from a packaging material dispenser, and relative rotation is provided between the dispenser and a load to wrap packaging material around the load. The packaging material is automatically released from the retainer in response to force applied by packaging material wrapped around the load or other unpowered actuation.

U.S. Pat. No. 4,102,513 relates to a dispenser for wrapping a roll of plastic stretch film under tension about an object. The dispenser has a reel assembly provided with an adjustable drag arrangement to set and adjust the tension on the film during the wrapping operation by the manipulation of a hand grip. Two hand grips are connected to and arranged relative to the reel assembly for the balance support thereof during wrapping. One hand grip is operatively associated with one of a pair of rotary end supports for the roll of film in such a way that movement of the one hand grip changes the drag on the roll and thereby the tension on the film during the wrapping thereof.

U.S. Design Pat. Nos. 317,394 and 382,429 relate to hand held dispensers for stretch wrap film.

U.S. Pat. No. 4,179,081 relates to an apparatus for the manual application of plastic stretch films to materials. The apparatus consists of an extended core for the supply of plastic stretch film and a pair of tubular like grip means for the extended core. The grip means serve as a manual control means for paying out the plastic stretch film and as a manual means for applying tension on the film. This patent requires a pair of flexible hand grips.

U.S. Pat. No. 4,248,392 relates to an apparatus for the application of plastic stretch films. The apparatus consists of a pair of insertable adaptors for the ends of a cylindrical core which hold a supply of plastic stretch film and a pair of tubular like grip means for the insertable adapters. This patent requires a pair of insertable adapters and a pair of flexible hand grips.

U.S. Pat. No. 4,477,037 relates to a stretch wrap film dispenser wherein the stretch wrap film is wound on a core which is longer than the roll of film to extend out of both ends. A rotatable handle is mounted on the core outboard of the film. Relative break nib between the handle and core is adjusted by a screw thread.

U.S. Pat. No. 4,484,717 relates to a stretch wrap film dispenser with single digit tension control. A break ring under at least one index finger can be clamped by that finger under the spindle to apply breaking.

SUMMARY OF THE INVENTION

The present invention relates to a hand dispenser for stretch film. The stretch film from the hand dispenser can be dispensed by using one hand from a person. The hand dispenser comprises a molded handle with prongs, a molded collar comprising a notched cylinder with flexible sections and a flange, and a foam sleeve for a cushion grip. The handle prongs are inserted into an extended core of the roll. The film is wound around one end of the extended core.

It is an object of the present invention for the collar to have a flange which keeps the person's hand off the roll as the film unwinds.

It is an object of the present invention for the molded collar to comprise a notched cylinder with flexible sections and a flange.

It is an object of the present invention for the cylinder to have flexible sections that fit over the extended core of the roll.

It is an object of the present invention for the flexible sections of the notched cylinder to be used as a brake if needed by applying slight pressure on the sleeve which fits over the notched cylinder.

It is an object of the present invention for the sleeve to be a foam sleeve for a cushion grip which fits over the handle as well as the flexible sections of the notched cylinder which is attached to the flange of the collar.

It is an object of the present invention for the sleeve to fit snuggly over the notched cylinder. It is an object of the present invention for the snug fit to compress the flexible sections of the notched cylinder enough to act as a slight brake against the extended core without additional pressure.

It is an object of the present invention to slide a roll of stretch wrap over the forks at the front of the dispenser and have the roll of film to snap into place.

It is an object of the present invention for a small amount of tension to activate the films holding power.

It is an object of the present invention for the dispenser to work on narrow film, i.e., film up to five inches.

It is an object of the present invention to notch the cylindrical portion of the collar.

It is an object of the present invention that pressure from the foam sleeve provide the braking action required with or without additional pressure from the fore finger at the top portion of the handle closest to where the roll of film is wound.

It is an object of the present invention for the handle to be reusable.

It is an object of the present invention for the handle to be easily removed from the device by squeezing together the two prongs at one end of the handle and pulling the handle out of the core.

It is an object of the present invention for the dispenser unit to allow a manufacturer of roll goods to wind a spiral of stretch film about the roll and around the ends of the goods.

It is an object of the present invention for the unit to have a manually operable breaking system that is adjustable to permit the application with breaking tension over a wide range.

It is an object of the present invention for the tension in the film to be controllable during the wrapping process.

It is an object of the present invention to provide a stretch wrap dispenser which has good balance and facilitates the application of film under substantially uniform tension across the full width of the film for a uniform wrap.

It is an object of the present invention to provide a stretch wrap film dispenser wherein the roll is easily replaced.

It is an object of the present invention to provide a stretch wrap film dispenser which can be adjusted to accommodate different widths of film rolls.

DETAILED DESCRIPTION OF THE INVENTION

Figure 1:
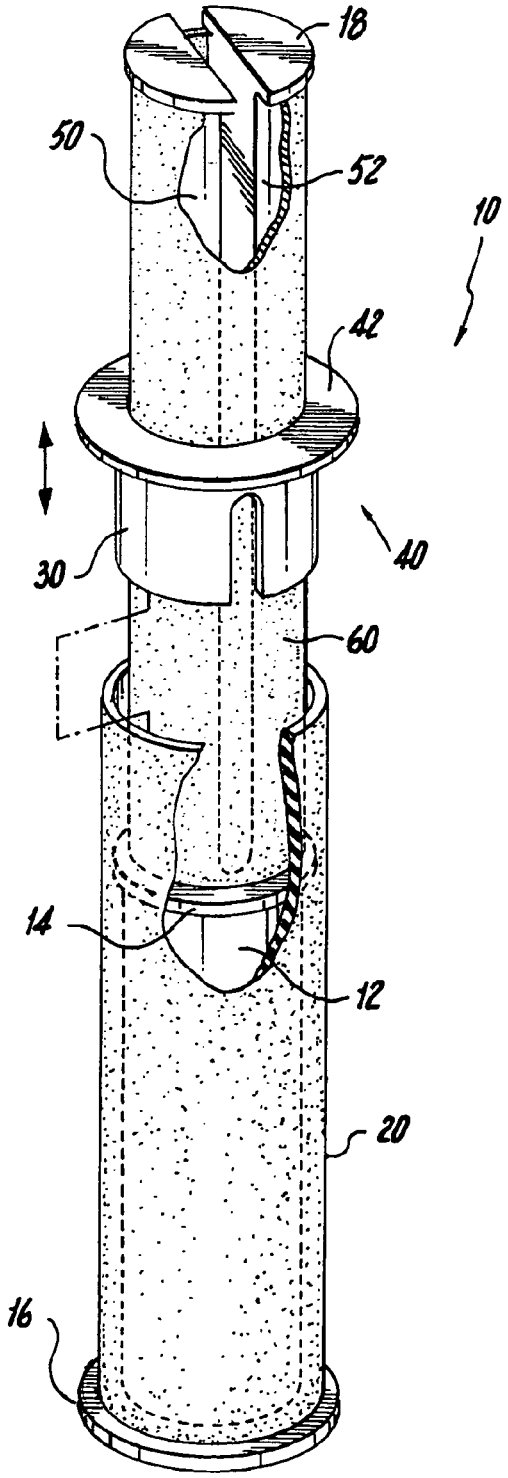
FIG. 1 illustrates an embodiment of a one handed dispenser of the present invention.

FIG. 1 shows a one handed dispenser showing a handle 12. The handle 12 in a preferred embodiment being molded. The handle 12 having a top flange 14 and a bottom flange 16. An additional flange 18 at the opposite end of the handle 12 is used to lock the film core in place once it has been inserted onto the prongs 50 and 52. The dispenser 10 has a molded collar 40 consisting of a notched cylinder 30 with a flange 42. The dispenser 10 has a foam sleeve 20 for a cushion grip which fits over the handle 12 and extends beyond the top flange 14 of the handle 12. The molded collar 40 fits over the extended core 60 so that the notched cylinder 30 is recessed beneath the foam sleeve 20 and rests against the top flange 14 of the handle 12. The sleeve 20 fits snugly over the notched cylinder 30. The snug fit compresses the notched cylinder 30 enough to act as a slight brake against the extended core 60 without additional pressure. If desired, additional pressure applied to the handle at this point forces the notched cylinder 30 to compress against the extended core 60 of the roll of film resting against the top flange 14 of the handle 12 thereby acting as a further brake by increasing the friction between the notched cylinder 30 and the extended core 60. This will increase the tension of the film as it unwinds. Handle prongs 50 and 52 are inserted into the extended core 60. A film (not shown in FIG. 1) is wound around one end of the extended core 60. The collar 40 has a flange 42 to keep the hand off the edge of the roll as it unwinds.

Figure 2:
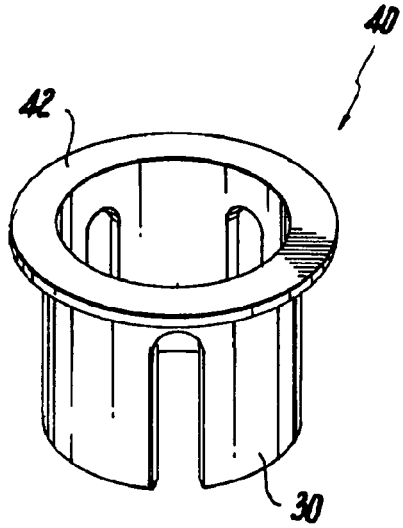
FIG. 2 illustrates the collar shown in FIG. 1.

FIG. 2 shows the collar 40 having a notched cylinder 30 and a flange 42.

Figure 3:
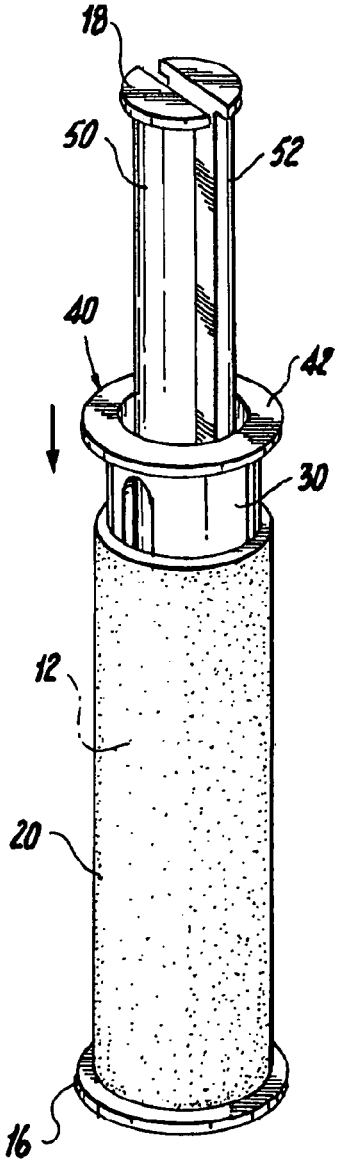
FIG. 3 shows the handle, the collar and the foam sleeve of the device shown in FIG. 1.

FIG. 3 shows the handle 12 which has the handle prongs 50 and 52. The notched cylinder portion 30 of the collar 40 is inserted into the foam sleeve 20 with the flange 42 showing above the top of the foam sleeve 20.

Figure 4:
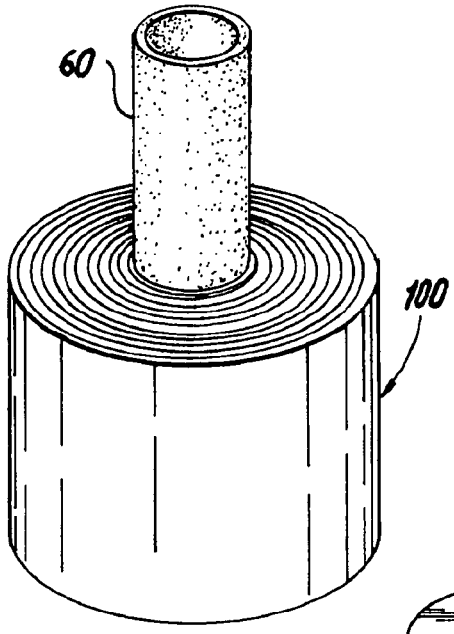
FIG. 4 shows the roll of film wound on one end of an extended core.

FIG. 4 shows a roll of film 100 wound onto one end of an extended core 60.

Figure 5:
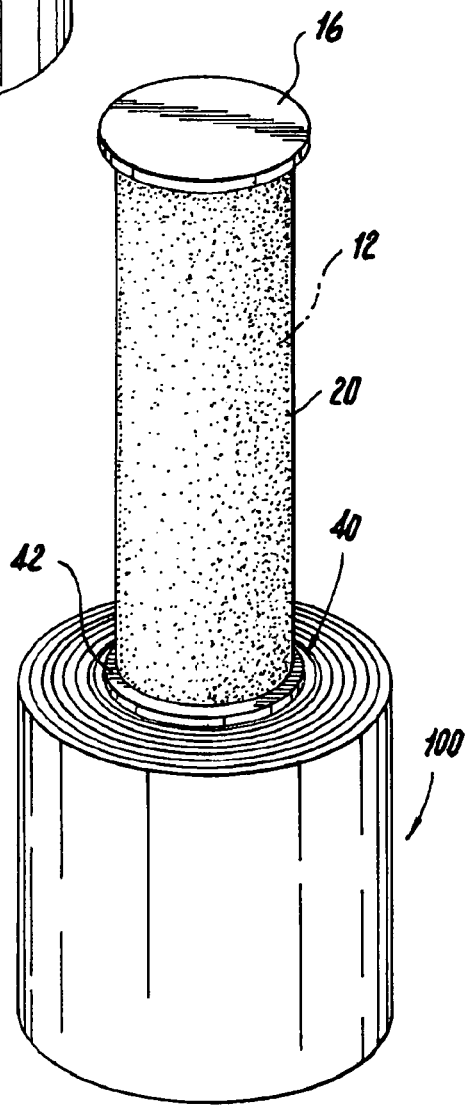
FIG. 5 shows the roll of film that is then attached to the complete device 10 shown in FIG. 1.

FIG. 5 shows the roll of film 100 attached to the handle 12 with the collar 40 in place and the flange 42 separating the foam sleeve 20 on the handle from the roll of film 100.

The invention claimed is:

1. A hand dispenser for stretch film comprising:

a roll of stretch film having a width wound around a core;

the core having a portion extending beyond the width of the film at least at one end of the core;

a single handle having prongs, the handle including a first flange and a second flange;

a separate sleeve positioned over the handle, with a recess formed between the sleeve and the handle;

a collar separate from said handle;

said collar comprising a notched cylinder with flexible sections attached to a flange;

said notched cylinder fitting over said extending portion of the core and inside the recess between the sleeve and handle; and an additional flange on an end of the prongs of the handle, the prongs extending through the core to lock the core in place between the additional flange and the first flange.

2. The hand dispenser of claim 1 wherein said stretch film is adapted to be dispensed by using one hand.

3. The hand dispenser of claim 1 wherein said core is placed over said handle prongs and inserted into a recess formed between the notched collar inside said sleeve and the prongs.

4. The hand dispenser of claim 1 wherein said collar flange is adapted to keep a person's hand from coming in contact with an edge of the roll of film as the film unwinds.

5. The hand dispenser of claim 1 wherein said flexible sections of said notched cylinder are adapted to be used as a brake if needed by applying slight pressure on said sleeve which fits over said flexible sections of said notched cylinder.

6. The hand dispenser of claim 1 wherein said sleeve is for a cushion grip, and fits over said handle as well as said flexible sections of said notched cylinder.

7. The hand dispenser of claim 1 wherein said separate sleeve fits snuggly over said notched cylinder, and said snug fit compresses said notched cylinder enough to create slight friction which acts as a brake against the exterior surface of the extended core without additional pressure.

8. The hand dispenser of claim 1 wherein the separate sleeve is made of foam.

9. The hand dispenser of claim 1 wherein the dispenser is adapted to require no additional tension to activate a films holding power.

10. The hand dispenser of claim 1 wherein said stretch film has a width of no more than five inches.

11. The hand dispenser of claim 1 wherein said flange of the separate collar is a perpendicular flange.

12. The hand dispenser of claim 1 wherein adjustable pressure through the separate sleeve and separate collar provides additional braking action.

13. The hand dispenser of claim 1 wherein said handle is reusable.

14. The hand dispenser of claim 1 wherein said handle consists of two prongs.

15. The hand dispenser of claim 1 wherein said dispenser has a manually operable braking system that is adjustable to permit application of braking tension.

16. The hand dispenser of claim 1 wherein tension in the film is controllable during a wrapping process.

17. The hand dispenser of claim 1 wherein said dispenser provides balance and facilitates application of film under substantially uniform tension across the full width of said film for a uniform wrap.

18. The hand dispenser of claim 1 wherein the roll of film is easily inserted, removed and replaced.

19. The hand dispenser of claim 1 wherein said dispenser is adjusted to accommodate different widths of film.

20. The hand dispenser of claim 1 wherein said handle prongs are adapted to be squeezed together, and after being squeezed together are adapted to be inserted through said core to prevent said core from sliding off because of the additional flange located at end of said prongs.

* * * * *